United States Patent [19]

Becker et al.

[11] 4,449,860

[45] May 22, 1984

[54] MINE ROOF SUPPORTS

[75] Inventors: Kunibert Becker, Werl; Burckhard Elsner, Lunen; Rudiger Kirchbrucher, Dortmund-Brackel, all of Fed. Rep. of Germany

[73] Assignee: Gewerkschaft Eisenhutte Westfalia, Lunen, Fed. Rep. of Germany

[21] Appl. No.: 367,513

[22] Filed: Apr. 12, 1982

[30] Foreign Application Priority Data

Apr. 22, 1981 [DE] Fed. Rep. of Germany ..... 3115984

[51] Int. Cl.[3] ..... E21D 17/054

[52] U.S. Cl. ..... 405/293; 405/291

[58] Field of Search ..... 405/291, 293, 294, 295; 299/31, 33

[56] References Cited

U.S. PATENT DOCUMENTS 4,266,892 5/1981 Maykemper ..... 405/293

4,347,021 8/1982 Elsner et al. ..... 405/293

FOREIGN PATENT DOCUMENTS 1234661 6/1971 United Kingdom ..... 405/294

*Primary Examiner*—David H. Corbin

*Attorney, Agent, or Firm*—Sughrue, Mion, Zinn, Macpeak and Seas

[57] ABSTRACT

A mine roof support has a main roof bar which is pivotably connected to an auxiliary forwardly-extendible bar. At least one piston and cylinder unit serves to swing the auxiliary bar about the main bar to bring the auxiliary bar into a roof-contacting position aligned with the main bar or into a stowed position beneath the main bar or into some intermediate position. One or more pivotable guide levers connect the auxiliary bar to the piston and cylinder unit. A guide member is also connected to the unit and slidably locates in longitudinal guideways formed in ribs or the like at the underside of the main roof bar.

15 Claims, 7 Drawing Figures

FIG.5
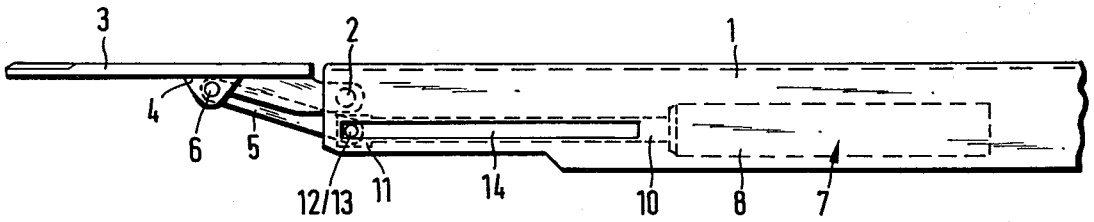
FIG.6
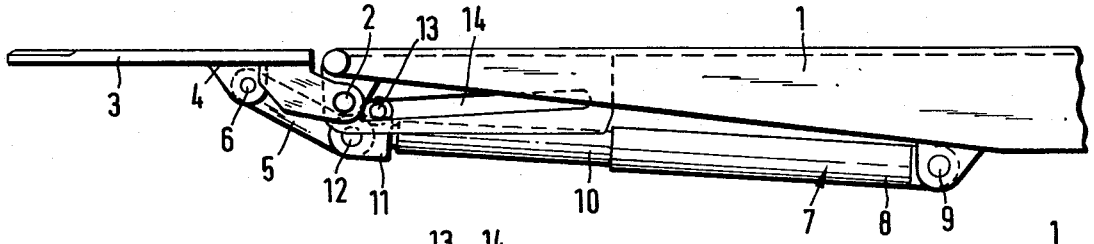
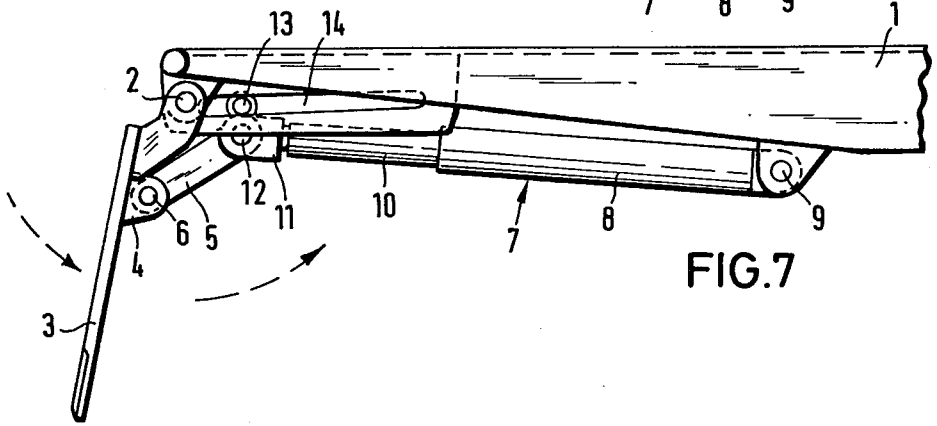
FIG.7

MINE ROOF SUPPORTS

BACKGROUND TO THE INVENTION

The present invention relates in general to mine roof supports and more particularly to roof-contacting structures of such supports which are provided with appliances for forwardly extending the structures. The term "roof-contacting structures" is intended to refer to simple bars or girders or to larger caps, linings or canopies which make contact with the roof of a mine working when the props of the support are extended.

It is known to provide the main roof-contacting structure e.g. a cap or bar, of a mine roof support with an auxiliary lining or structure which is pivotably connected thereto. A piston and cylinder unit can then be used to pivot the auxiliary roof-contacting structure about the main structure to bring the auxiliary structure into contact with the roof of the pertinent mine working. Other types of advanceable or forwardly extendible appliances cause the auxiliary structure to slide in or out relative to the main structure.

German patent specification No. 1230745 describes an appliance of the aforementioned kind wherein the piston and cylinder unit used to pivot the auxiliary bar is protected from the forces exerted by the roof on the auxiliary bar. The piston and cylinder unit is pivotably connected to an intermediate guide piece which is slidably mounted to the main bar and which connects to the auxiliary bar via a short pivotal strap. This known arrangement is apt to suffer from considerable wear, especially the slidable mounting of the intermediate guide piece, and is relatively costly to manufacture. In addition, the auxiliary bar can only be pivoted through a relatively small angle, e.g. 15°. In the event of excessive roof pressure, the auxiliary bar of this known arrangement is prone to suffer damage together with the associated guide components even if the piston and cylinder unit is itself protected by the self-locking action of the guide components. The self-locking action of the guide components also means that the portion of the roof in contact with the auxiliary bar is not always adequately supported since the piston and cylinder unit forms no part of the support.

U.S. Pat. No. 4,347,021 assigned the same assignee as the present application is concerned with an improved pivoting linkage composed of several levers coupled between the auxiliary and main bars and the piston and cylinder units. In this arrangement, the auxiliary bar can be swung through a considerable angle in the order of 180° between its operative and stowed positions.

A general object of this invention is to provide an improved form of extendible roof-contacting structure for a mine roof support.

BRIEF SUMMARY OF THE INVENTION

The invention provides a multi-part extendible roof-contacting structure which is composed of a main structure, an auxiliary structure pivotably connected to the main structure and an appliance or device for pivoting the auxiliary structure about the main structure to effect the extension as is known per se. The auxiliary structure can be pivoted about the main structure between an operative position aligned with the main structure and an in-operative position stowed beneath the main structure. The operating appliance or device which moves the auxiliary structure between these positions employs at least one piston and cylinder unit supported by the main structure and linked via one or more pivotable guide levers to the auxiliary structure. Slidable guidance for the unit is established by a guide member connected directly or indirectly to the unit and engaging in guideways, such as longitudinal slots, in the main structure.

In one embodiment of the invention an extendible roof bar is composed of a main roof bar and an auxiliary roof bar, a pivot joint between the main and auxiliary roof bars, a piston and cylinder unit carried by the main bar and disposed therebeneath, a guide lever, a pivot joint connecting the guide lever to the auxiliary roof bar, a pivot joint connecting the guide lever to the piston and cylinder unit and means effecting a slidable guide connection between the piston and cylinder unit and the main roof bar in the vicinity of the pivot joint connecting the gide lever to the unit. The piston and cylinder unit can be extended and retracted to cause the auxiliary roof bar to swing about the pivot joint between the main and auxiliary roof bars to adopt an operative position aligned with the main roof bar and an inoperative position stowed beneath the main roof bar.

Normally the piston rod of the unit would be connected to the guide lever and to the slidable guide member either directly or via a connector. Conveniently the slidable guide member may take the form of a spindle or rod which may also serve as a pivot joint linking the unit to the guide lever. It is however preferred to offset the latter pivot joint and the slideable guide member.

By selecting suitable lengths for the components, it is possible to obtain a mechanical advantage in respect of the force produced by the piston and cylinder unit. The auxiliary bar or equivalent can be neatly stowed beneath the main bar or equivalent and the overall appliance which effects its movement can be compact and protected beneath the main bar. The piston and cylinder unit holds the auxiliary bar in its set position and this unit can be locked hydraulically to maintain this set position. The unit can however be protected by a pressure-relief valve which opens should excess load become imposed on the auxiliary bar.

With larger roof contacting structures it is possible to utilize several devices or appliances each with a piston and cylinder unit and guide means as described arranged in side-by-side relationship across the structures.

BRIEF DESCRIPTION OF DRAWINGS

The invention may be understood more readily, and various other features of the invention may become apparent, from consideration of the following description.

Embodiments of the invention will now be described, by way of examples only, with reference to the accompanying drawings, wherein:

FIG. 5 is a schematic side view of another multi-part extendible roof contacting structure of a mine roof support constructed in accordance with the invention;

FIG. 6 is a schematic side view of a further multi-part extendible roof contacting structure of a mine roof support constructed in accordance with the invention and FIG. 7 is a side view of the structure shown in FIG. 6 in another operating position.

DESCRIPTION OF PREFERRED EMBODIMENT

In general, a roof support of any suitable type is arranged in an underground mine working. This support, not shown in detail, employs an extendible roof bar composed of a main roof contacting structure supported by one or more props and an auxiliary roof contacting structure capable of forming an optional forward extension for the main structure.

Figure 4:
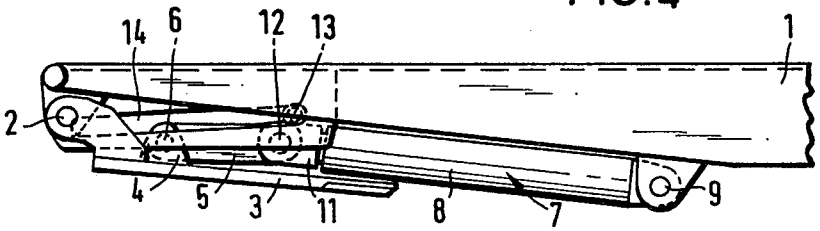

As shown in FIGS. 1 to 4, the main structure is designated 1 while the auxiliary structure is designated 3. The main and auxiliary structures 1, 3 are connected directly together by at least one pivot joint 2. The joint 2 defines a pivot axis which extends more or less horizontally and generally parallel to the mineral face during use. As is known, an appliance or device serves to swing the structure 3 about the structure 1 and with the aid of this device the structure 3 can be brought into an operating position aligned or coplanar with the main structure 1 (FIG. 1) or a non-working position stowed beneath the main structure 1 as shown in FIG. 4. In moving between the working and stowed positions the structure 3 swings through an angle of about 180°.

In the present embodiment, the appliance takes the form of a plurality of hydraulic piston and cylinder units 7 which are disposed beneath the main structure 1 in positions slightly inclined to the longitudinal axis of the latter. The cylinders 8 of the units 7 are connected with pivot joints 9 to the structure 1 while the piston rods 10 thereof are connected by connectors or head pieces 11 to respective guide levers 5 via pivot joints 12. At the underside of the auxiliary structure 3, there are lugs 4 or the like which serve to support pivot joints 6 for linking the structure 3 to the guide levers 5. The pivot joints 2,6,12,9 define pivot axes which are mutually parallel and the joints 2,6 12 are spaced apart as shown.

Figure 2:
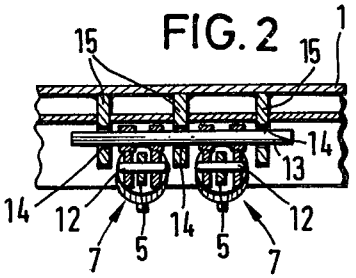
FIG. 2 is a sectional end view of the structure shown in FIG. 1, the view being taken along the line II—II of FIG. 1.

The connectors 11 which link the piston rods 10 to the pivot joints 12 also support a rod 13 serving as a slidable guide member which is spaced from the joints 12. The rod 13 slidably locates within guideways 14 at the underside of the main structure 1. As shown in FIG. 2, the underside of the main structure 1 is provided with downwardly projecting parallel ribs 15 which are provided with longitudinal slots providing the guideways 14. The guide member or rod 13 can be mounted so as to be freely rotatable about its longitudinal axis while being displaceably connected with the connectors 11. The slots which form the guideways 14 incline from the forward end near the structure 3 in a direction towards the upper surface of the main structure 1 at the rear. The angle of inclination of the slots is in the order of 5°–15°. The forward ends of the slots lie adjacent to the joint 2.

Figure 1:
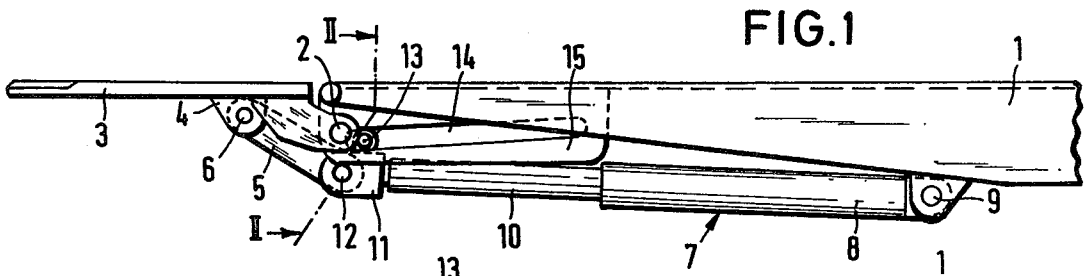
FIG. 1 is a schematic side view of an extendible multi-part roof contacting structure of a mine roof support constructed in accordance with the invention.
Figure 3:
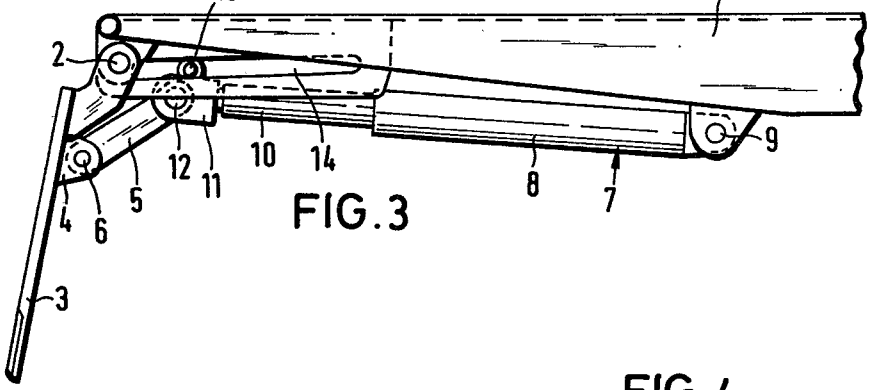
FIGS. 3 and 4 are side views of the structure shown in FIG. 1 in different operating positions.

The provision of the guide levers 5 and the guide member 13 sliding in the guideway 14 overall serves to guide the displacement of the structure 3 between its working and non-working positions. FIG. 1 depicts the structures 1, 3 in their aligned position where the piston rods 7 are fully extended or almost fully extended and the guide rod 13 is disposed near the front ends of the guideways 14. On retraction of the piston and cylinder units 7, the structure 3 swings about the structure 2 through a position depicted in FIG. 3 to the stowed position depicted in FIG. 4 where the guide rod 13 is located at the rear ends of the guideways 14.

Although the operating appliance and guide means therefor has been described as the plural components 7,11,5 etc. it is possible to provide a single piston and cylinder unit and a single guide lever 5 or conversely to provide more than two such components. It is also possible to link a plurality of piston and cylinder units to the structure 3 via a single guide lever 5. In general, the dimensions of the guide lever or guide levers 5 are chosen to ensure that the distance between the pivot joints 6 and 12 is considerably greater than the distance between the slidable guide rod 13 and the pivot joint 12.

FIG. 5 depicts a modified arrangement where like reference numerals denote like parts to FIGS. 1 to 4. In this modified arrangement the unit(s) 7 lie parallel to the upper surface of the structure and are protected within the structure 1 by the provision of side flanges; the slots forming the guideways 14 are included in the side flanges and also take a disposition parallel to the upper roof-contacting surface of the structure 1 and the pivot joint 12 and the guide rod 13 are combined as a single component. The or each connector 11 thus carries a rod 12, 13 which locates in the slots forming the guideways 14 and also links with the guide lever(s) 5.

FIGS. 6 and 7 depict another modified arrangement where again like reference numerals denote like parts to FIGS. 1 to 4. In the construction represented in FIGS. 6 and 7 the guide rod 13 is fitted directly to the guide lever or levers 5 instead of to the connectors 11 or to the piston rod or rods 10. The rod 13 is preferably located above the joint 12 as shown near to the end of the or each guide lever 5.

We claim:

1. In or for a mine roof support, a multipart extendible roof contacting structure comprising: a main roof-contacting structure (1), an auxiliary roof-contacting structure (3) pivotably connected to the main structure, and an appliance for pivoting the auxiliary structure about the main structure between an operative position aligned with the main structure and an inoperative position stowed beneath the main structure, wherein said appliance employs at least one piston and cylinder unit (7) supported by the main structure, at least one pivotable guide lever (5) connected between the auxiliary structure and the piston and cylinder unit, and slidable guide means between the piston and cylinder unit and the main structure, and wherein the slidable guide means comprises guideways (14) on the main structure, and a guide member (13) slidably engaging in the guideways and coupled to the piston and cylinder unit for direct movement therewith.

2. A structure according to claim 1, wherein the cylinder of the piston and cylinder unit is supported by the main structure and the piston rod thereof is coupled to the guide lever and to the guide member of the slidable guide means.

3. A structure according to claim 1, wherein a connector (11) establishes connection between the piston and cylinder unit, the guide lever and the guide member of the slidable guide means.

4. A structure according to claim 1 wherein the guideways are slots in ribs or flanges (15) beneath the roof-contacting surface of the main structure and the guide member is a rod.

5. A structure according to claim 1, wherein the guide member connects directly with the guide lever.

6. A structure according to claim 1, wherein the guide member is coupled to a connector fixed to the piston rod of the unit and the guide lever is pivotably coupled to the connector at a position offset from the guide member.

7. A structure according to claim 1, wherein the guide member also serves as a pivot joint effecting a pivotal connection between the guide lever and the unit.

8. A structure according to claim 4, wherein the slots are inclined in relation to the roof-contacting surface of the main structure.

9. A structure according to claim 6, wherein the guide member is disposed closer to the upper roof-contacting surface of the main structure than the pivot connection linking the guide lever to the connector.

10. A structure according to claim 6, wherein the distance between the guide member and the pivot connection linking the guide lever to the connector is considerably smaller than the distance between the latter pivot connection and the pivot connection between the auxiliary structure and the guide lever.

11. A structure according to claim 1, wherein the guide member is freely rotatable.

12. A structure according to claim 1, wherein a plurality of guide levers are provided and said levers are interconnected through said guide member.

13. A structure according to claim 1, wherein a plurality of piston and cylinder units are provided and said units are interconnected through said guide member.

14. A mine roof support provided with an extendible roof bar, comprising: a main roof bar (1) and an auxiliary roof bar (3), a pivot joint (2) between the main and auxiliary roof bars, a piston and cylinder unit (7) carried by the main bar and disposed therebeneath, a guide lever (5), a pivot joint (6) connecting the guide lever to the auxiliary roof bar, a pivot joint (12) connecting the guide lever to the piston and cylinder unit, and means effecting a slidable guide connection between the piston and cylinder unit and the main roof bar in the vicinity of the pivot joint connecting the guide lever to the piston and cylinder unit, the slidable guide connection comprising a rod (13) engaging in elongate guides (14) in the main roof bar and coupled to the piston and cylinder unit for direct motion therewith whereby the piston and cylinder unit can be extended and retracted to cause the auxiliary roof bar to swing about the pivot joint between the main and auxiliary roof bars to adopt an operative position aligned with the main roof bar and an inoperative position stowed beneath the main roof bar.

15. In a multi-part roof contacting structure of a mine roof support comprising a main structure, an auxiliary structure pivotably connected to said main structure and guided for pivotal movement through an angle in the order of 180°, at least one piston and cylinder unit carried beneath the main structure for effecting the pivotal movement of the auxiliary structure and at least one guide lever pivotably connected to the auxiliary structure and to said unit; the improvement comprising elongate guideways in the main structure and a guide member slidably engaging in the guideways and operably coupled to said unit and to said at least one guide lever.

* * * * *